US005874920A

United States Patent [19]

Araki et al.

[11] Patent Number: 5,874,920

[45] Date of Patent: Feb. 23, 1999

[54] PORTABLE RADIO EQUIPMENT, AND BUILT-IN ANTENNA MOUNTING STRUCTURE AND SHIELDING STRUCTURE FOR THE PORTABLE RADIO EQUIPMENT

[75] Inventors: Tatsuhito Araki, Sapporo; Hidekatsu Kobayashi; Kazuya Odagiri, both of Kawasaki, all of Japan

[73] Assignee: Fujitsu Limited, Kawasaki, Japan

[21] Appl. No.: 710,536

[22] Filed: Sep. 19, 1996

[30] Foreign Application Priority Data

Jan. 26, 1996 [JP] Japan ..... 8-011622

[51] Int. Cl.[6] ..... H01Q 1/24

[52] U.S. Cl. ..... 343/702; 343/841

[58] Field of Search ..... 343/702, 841, 343/872, 906, 846; 455/89, 90

[56] References Cited

U.S. PATENT DOCUMENTS

| | | | |
|---|---|---|---|
| 4,924,237 | 5/1990 | Honda et al. | 343/702 |
| 5,268,702 | 12/1993 | Amano et al. | 343/846 |
| 5,300,938 | 4/1994 | Maroun et al. | 343/702 |
| 5,394,160 | 2/1995 | Iwasaki et al. | 343/841 |
| 5,428,362 | 6/1995 | Chatzipetros et al. | 343/702 |
| 5,493,702 | 2/1996 | Crowley et al. | 343/702 |
| 5,667,403 | 9/1997 | Fukuda et al. | 439/489 |

*Primary Examiner*—Don Wong
*Assistant Examiner*—Tan Ho
*Attorney, Agent, or Firm*—Staas & Halsey

[57] ABSTRACT

A built-in antenna mounting structure for portable radio equipment, including a shield chassis formed of molded resin, whose surface except an antenna mounting surface is treated with a conductive material, a printed wiring board mounted on the shield chassis and having a transmitting/receiving circuit, and a built-in antenna formed from a metal plate and mounted on the antenna mounting surface of the shield chassis. The built-in antenna has a platelike antenna element and an elastic short-circuit plate for short-circuiting the antenna element to the shield chassis. The shield chassis is held at an edge portion thereof between the short-circuit plate and the antenna element, thereby mounting the built-in antenna on the shield chassis.

12 Claims, 11 Drawing Sheets

PORTABLE RADIO EQUIPMENT, AND BUILT-IN ANTENNA MOUNTING STRUCTURE AND SHIELDING STRUCTURE FOR THE PORTABLE RADIO EQUIPMENT

BACKGROUND OF THE INVENTION

1. Field of the Invention

The present invention relates to a built-in antenna mounting structure and a shielding structure for portable radio equipment such as a portable telephone and a cordless telephone.

2. Description of the Related Art

In recent years, portable radio equipment such as a portable telephone has widely been put to practical use in response to an increase in communications demand. Portable radio equipment usually includes an antenna built in a housing of the equipment, so as to ensure a receiving function in carrying the equipment. The built-in antenna is required to be fit for a reduction in size and weight of the equipment and excellent in assemblability, based on a premise that desired electrical characteristics on resonance frequency, bandwidth, gain, etc. have been obtained.

Further, in response to the requirement of a reduction in size and weight of the portable radio equipment, it is necessary to use a thin-walled case, in which many high-density mounted electronic components are accommodated. Such portable radio equipment uses a high-frequency band ranging from about 800 to 900 MHz, which is called a quasi-microwave band. Accordingly, it is necessary to intensify electromagnetic shield in the case reduced in weight and thereby prevent various troubles due to electromagnetic interference.

As a built-in antenna in a conventional portable telephone, a platelike inverted F-shaped antenna is known. The inverted F-shaped antenna is directly mounted on a printed wiring board to ensure a receiving function during standby. Further, a conventional shielding structure for a portable telephone is provided by soldering a U-shaped spring to a ground pattern on a printed wiring board, forming a metal film by plating, electrostatic coating, aluminum deposition, etc. on the inner surface of a molded resin case having a rib, and engaging the U-shaped spring with the rib to bring the spring into contact with the inner surface of the case.

However, in the conventional built-in antenna mounting structure as mentioned above, the built-in antenna is mounted on the printed wiring board, so that a component mounting region on the printed wiring board cannot be easily ensured, causing a difficulty of size reduction and thickness reduction of the portable radio equipment. Further, in the conventional shielding structure, the U-shaped spring is soldered to the printed wiring board, so that a man-hour for mounting the spring is increased, and this shielding structure cannot support high-density mounting.

SUMMARY OF THE INVENTION

It is therefore an object of the present invention to provide a built-in antenna mounting structure and a shielding structure for portable radio equipment which are fit for high-density mounting of components.

In accordance with an aspect of the present invention, there is provided a built-in antenna mounting structure for portable radio equipment, comprising a shield chassis formed of molded resin, whose surface except an antenna mounting surface is treated with a conductive material; a printed wiring board mounted on the shield chassis and having a transmitting/receiving circuit; a built-in antenna formed from a metal plate and mounted on the antenna mounting surface of the shield chassis, the built-in antenna having a platelike antenna element and an elastic short-circuit plate for short-circuiting the antenna element to the shield chassis; and a coaxial cable having a core for connecting the transmitting/receiving circuit and the built-in antenna; wherein the shield chassis is held at an edge portion thereof between the short-circuit plate and the antenna element, thereby mounting the built-in antenna on the shield chassis, and the core of the coaxial cable is soldered to the antenna element at a position spaced a given distance from the short-circuit plate.

The built-in antenna is mounted on the shield chassis. Accordingly, a component mounting region on the printed wiring board can be sufficiently ensured to thereby realize size reduction, thickness reduction, and cost reduction of the portable radio equipment.

In accordance with another aspect of the present invention, there is provided a shielding structure for portable radio equipment, comprising a shield chassis formed of molded resin, whose surface is treated with a conductive material; a multilayer printed wiring board mounted on the shield chassis and having one surface on which a high-frequency oscillator, a high-frequency filter, and an isolator are mounted; a metal shield plate having a body portion and an elastically deformable tongue bent at substantially right angles to the body portion, the metal shield plate being mounted on the multilayer printed wiring board so that the tongue is in pressure contact with the shield chassis, and the high-frequency oscillator is isolated from the high-frequency filter and the isolator by the body portion; and a positioning means for positioning the metal shield plate to the multilayer printed wiring board.

According to the shielding structure of the present invention, at least a pair of feet of the metal shield plate are soldered to at least a pair of pads connected to an inner ground layer of the nultilayer printed wiring board, and the tongue of the metal shield plate is in pressure contact with the shield chassis. Accordingly, the high-frequency oscillator can be effectively electromagnetically shielded from the high-frequency filter and the isolator mounted on the multilayer printed wiring board at positions very close to the high frequency oscillator.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1:
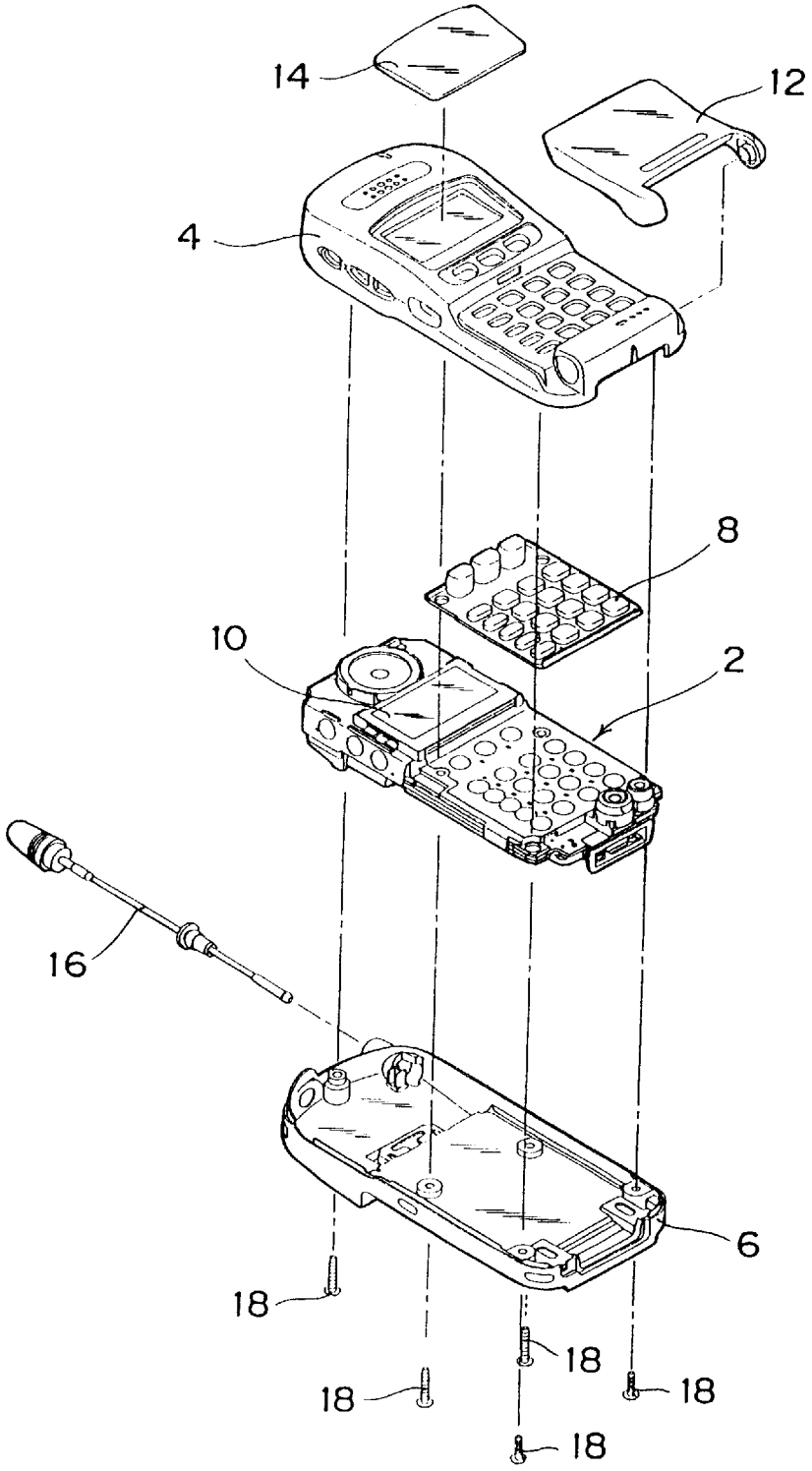
FIG. 1 is an exploded perspective view of a portable telephone having a built-in antenna mounting structure and a shielding structure according to the present invention.

Referring to FIG. 1, there is shown an exploded perspective view of a portable telephone having a built-in antenna mounting structure and a shielding structure according to the present invention. Reference numeral 2 denotes a printed wiring board assembly, which has a liquid crystal display 10. A key pad 8 is mounted on the printed wiring board assembly 2. The printed wiring board assembly 2 on which the key pad 8 is mounted is sandwiched by a front case 4 and a rear case 6, and screws 18 are tightened to the rear case 6, the printed wiring board assembly 2, and the front case 4, thereby integrally assembling them together. A rod antenna 16 is mounted in the rear case 6 so that it can be extracted from and stored into the rear case 6. The rod antenna 16 is usually extracted for use in telephone call. A cover 12 and a display window 14 are mounted on the front case 4.

Figure 2:
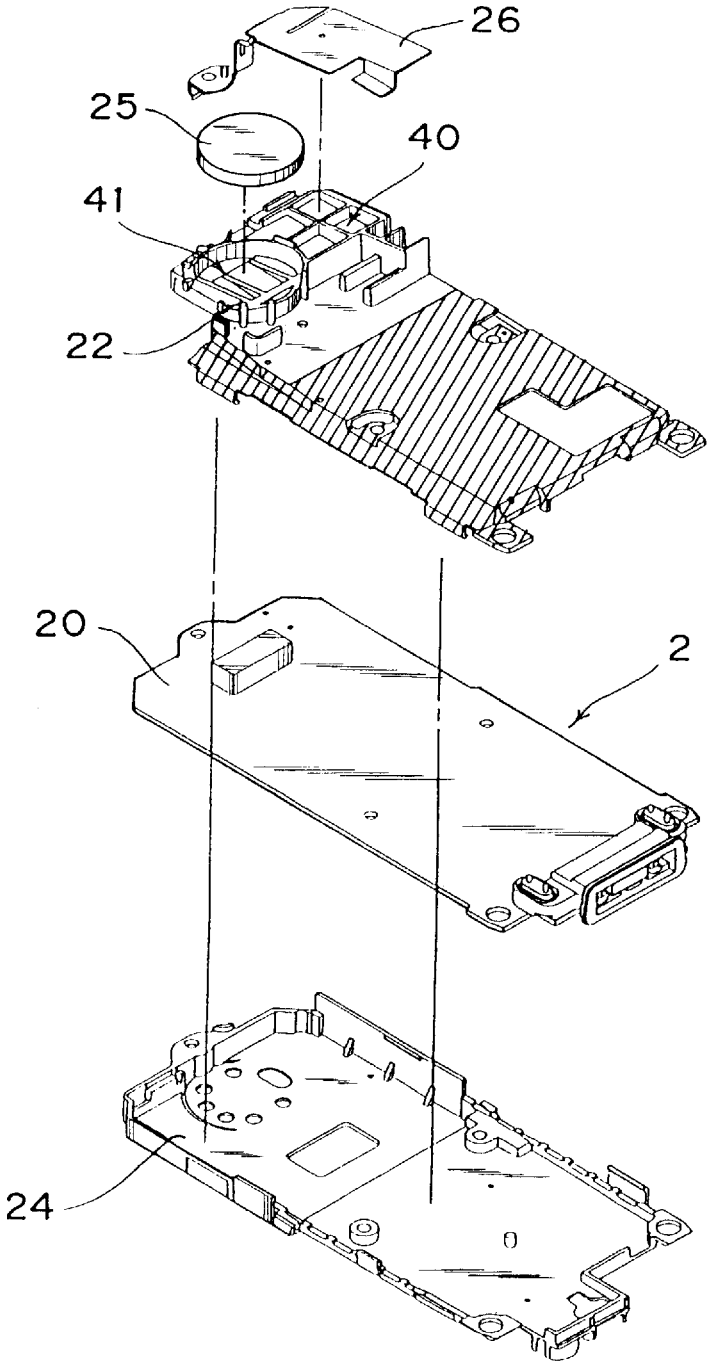
FIG. 2 is an exploded perspective view of a printed wiring board assembly.

Referring to FIG. 2, there is shown an exploded perspective view of the printed wiring board assembly 2 as viewed from the back side thereof. The printed wiring board assembly 2 is configured by sandwiching a multilayer printed wiring board 20 between a shield chassis 22 and a front shield 24. The shield chassis 22 is formed of molded resin, and the front and rear surfaces of the shield chassis 22 except an antenna mounting surface 40 and a vibrator mounting surface 41 thereof are treated with a conductive material as shown by hatching. A vibrator 25 is mounted on the vibrator mounting surface 41. Similarly, the front shield 24 is formed of molded resin, and the whole surface of the front shield 24 is treated with a conductive material. More specifically, such treatment with a conductive material is electroless plating, in which copper plating as a base film is formed on the surface, and nickel plating is next formed on the copper plating.

Figure 4:
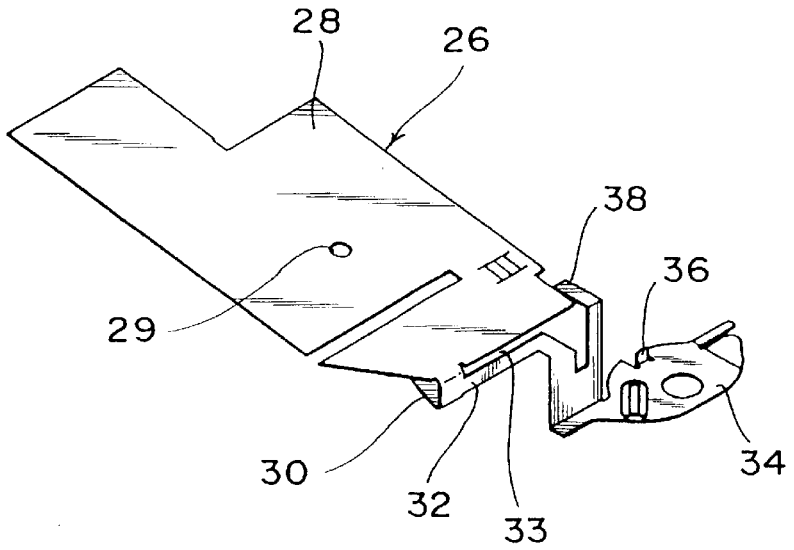
FIG. 4 is a perspective view of the built-in antenna.

Reference numeral 26 denotes an inverted F-shaped built-in antenna, which is formed by bending and blanking a metal plate of copper of the like. As best shown in FIG. 4, the built-in antenna 26 includes a platelike antenna element 28, a connecting portion 32 bent at substantially right angles to the antenna element 28, a ground element 34 parallel to the antenna element 28, and a short-circuit plate (short pin) 30.

Reference numeral 38 denotes a soldering portion to be soldered to an outer conductor of a coaxial cable. The soldering portion 38 and the ground element 34 are in conduction. A slit 33 is formed between the antenna element 28 and the connecting portion 32. The antenna element 28 has a positioning hole 29. The ground element 34 has an engaging projection 36 for fixing the ground element 34 to the shield chassis 22.

Figure 3:
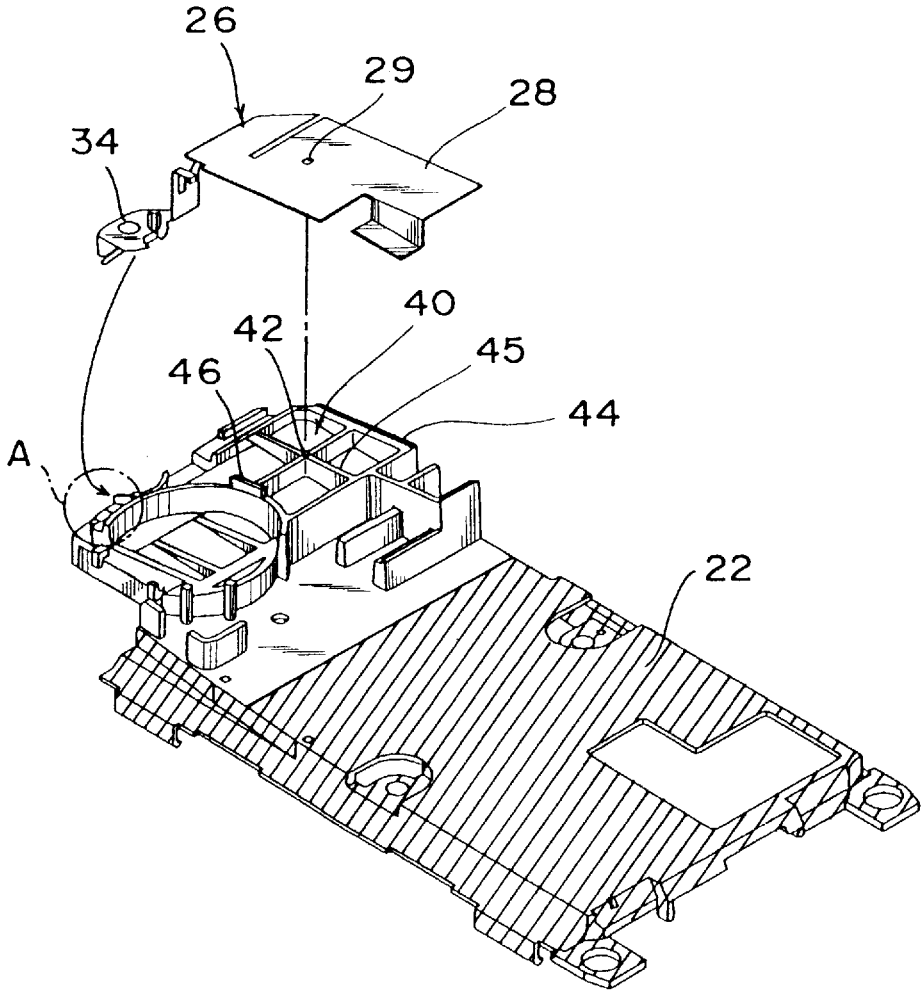
FIG. 3 is an exploded perspective view showing mounting of a built-in antenna to a shield chassis.

Referring to FIG. 3, the shield chassis 22 has the antenna mounting surface 40. The antenna mounting surface 40 is not plated, but has an insulating property. The antenna mounting surface 40 includes a lattice-shaped rib 45 and two positioning ribs 44 and 46. A positioning projection 42 is provided at the center of the lattice-shaped rib 45. The positioning projection 42 is inserted into the positioning hole 29 of the antenna element 28.

Figure 5:
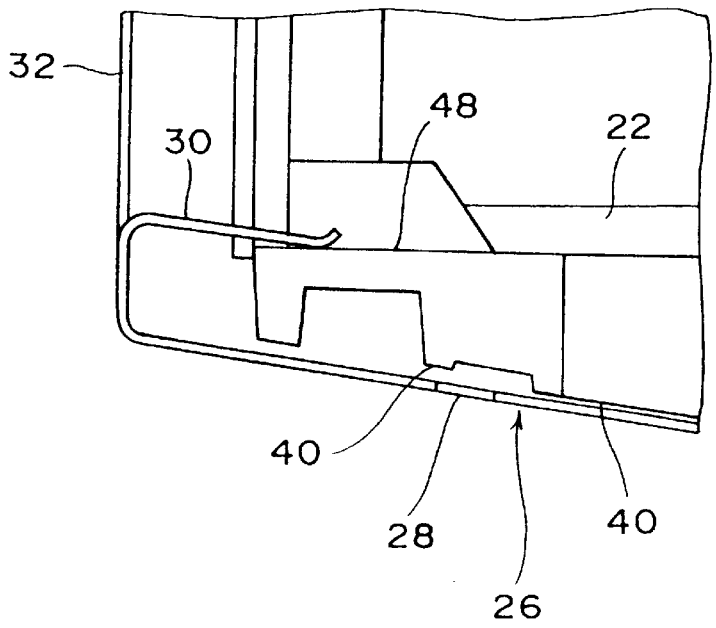
FIG. 5 is an enlarged view showing an engaged condition of a short-circuit plate and the shield chassis.

In mounting the antenna 26 on the antenna mounting surface 40 of the shield chassis 22, the opposite side edges of the antenna element 28 are fitted with the inside surfaces of the positioning ribs 44 and 46, and the positioning projection 42 is inserted into the hole 29 of the antenna element 28, thereby positioning the antenna 2 6 to the antenna mounting surface 40. At this time, as shown in FIG. 5, an edge portion of the shield chassis 22 is held between the short-circuit plate 30 having elasticity and the antenna element 28. The short-circuit plate 30 is brought into pressure contact with a nickel plating film 48 formed on the shield chassis 22.

Figure 6:
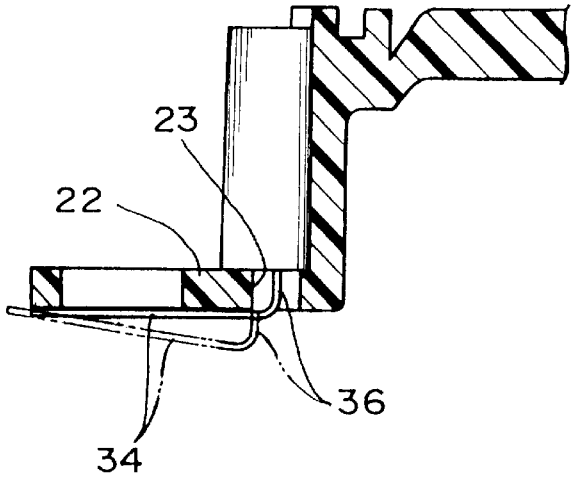
FIG. 6 is an enlarged sectional view of an encircled portion A shown in FIG. 3.

Further, as shown in FIG. 6, the engaging. projection 36 of the ground element 34 is engaged into a hole 23 formed through the shield chassis 22, thereby fixing the ground element 34 to the shield chassis 22. Preferably, the antenna element 28 is bonded to the antenna mounting surface 40 by using a double-sided adhesive tape, in order to ensure the fixation of the antenna element 28 to the antenna mounting surface 40.

Figure 7:
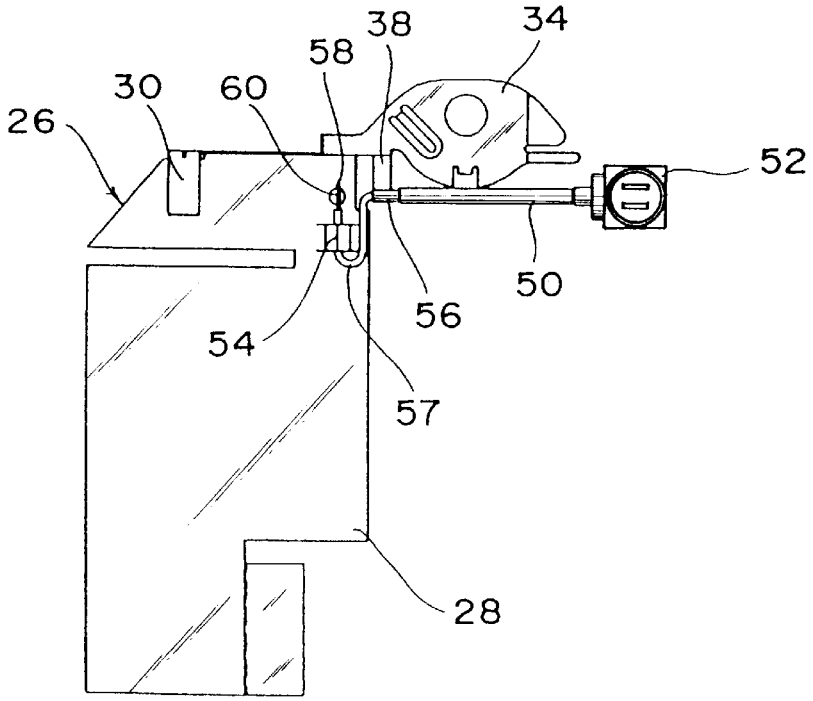
FIG. 7 is a back elevation of the built-in antenna.

As shown in FIG. 7, a coaxial connector 52 is connected to one end of a coaxial cable 50. The coaxial connector 52 is connected to a transmitting/receiving circuit mounted on the printed wiring board 20. An outer sheath of the coaxial cable 50 at the other end thereof is removed, and an outer conductor 56 of the coaxial cable 50 is soldered to the soldering portion 38 of the antenna 26. The antenna element 28 is formed with a bridge 54 substantially parallel to a wiring direction of the coaxial cable 50. A core (inner conductor) 58 covered with an insulating film 57 is passed under the bridge 54, and the core 58 is soldered to the antenna element 28 at a feeding point 60.

Figure 8A:
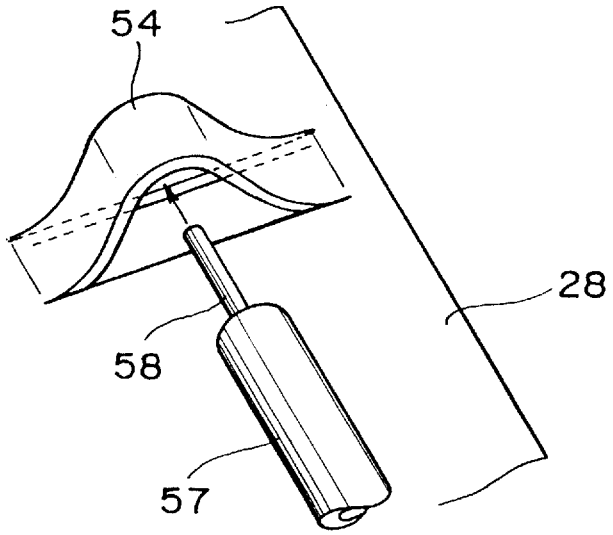
FIGS. 8A and 8B are perspective views illustrating a fixing method for a core of a coaxial cable.
Figure 8B:
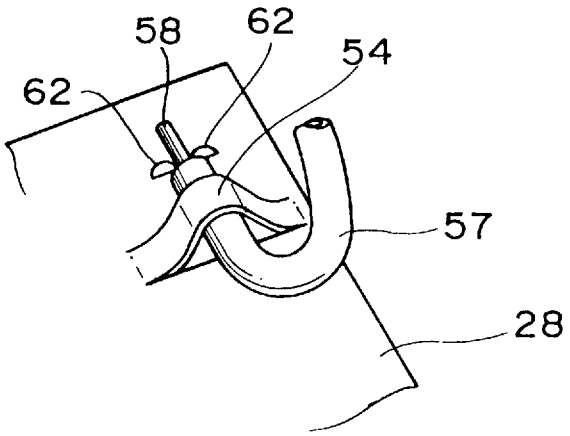

More specifically, as shown in FIG. 8A, the core 58 is passed under the bridge 54, and as shown in FIG. 8B, the core 58 is next passed between a pair of projections 62 mutually spaced a distance slightly larger than the diameter of the core 58, thereby positioning the core 58. Then, the core 58 is soldered to the antenna element 28. With this arrangement, the feeding point 60 of the antenna 26 can be spaced a pre-calculated distance from the short-circuit plate 30. Since the core 58 is soldered to the antenna element 28 after passing the core 58 under the bridge 54 extending in a direction substantially parallel to the wiring direction of the coaxial cable 50, a load to the core 58 at the feeding point 60 can be reduced.

Further, a ground surface of the built-in antenna 26 (inverted F-shaped antenna) can be made common to the conductive back surface of the shield chassis 22 for shielding the printed wiring board 20. Accordingly, the antenna element 28 can be mounted on the unplated antenna mounting surface 40 of the shield chassis 22, and it is unnecessary to provide an antenna mounting region on the printed wiring board 20. Therefore, the printed wiring board can be reduced in size, thereby allowing size reduction of the portable telephone itself attainable.

Figure 9:
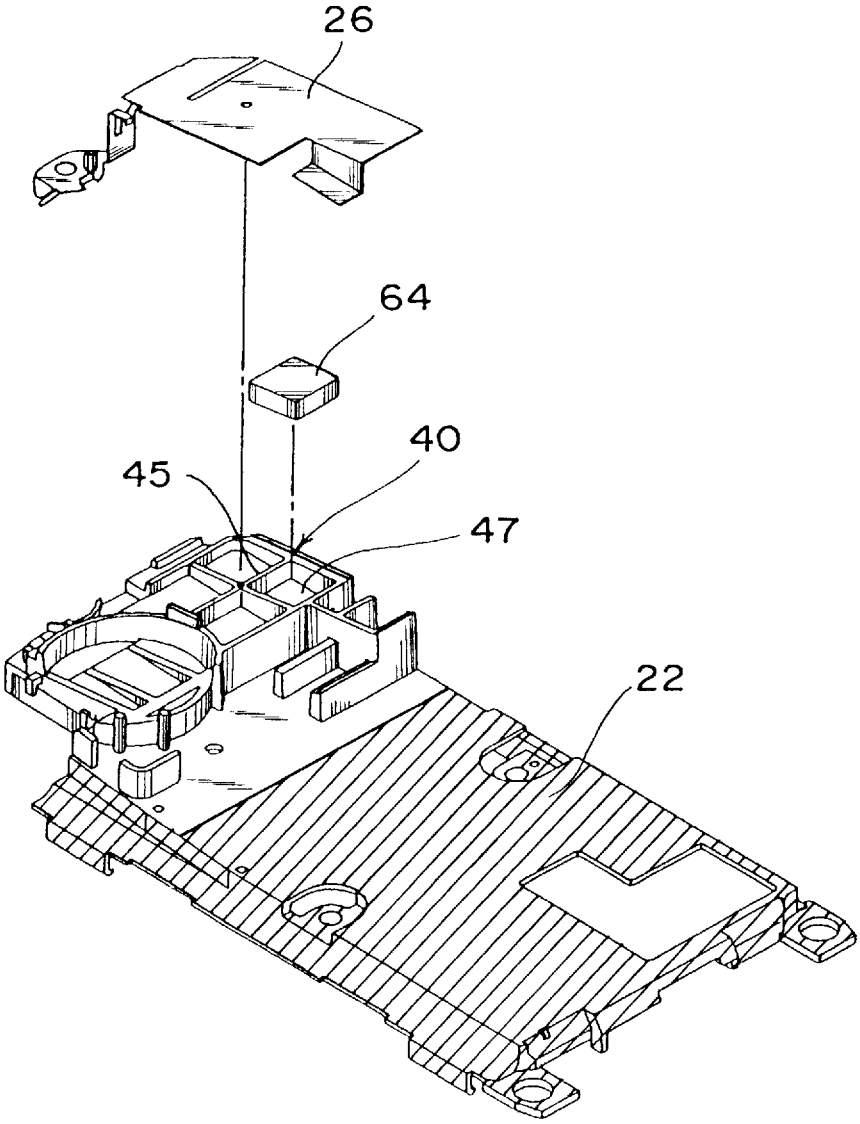
FIG. 9 is an exploded perspective view showing another preferred embodiment of the built-in antenna mounting structure.

Referring to FIG. 9, there is shown a built-in antenna mounting structure according to another preferred embodiment of the present invention. In this preferedr embodiment, a dielectric 64 is inserted in a pocket 47 defined by the lattice-shaped rib 45 of the antenna mounting surface 40. With this arrangement, antenna characteristics of the built-in antenna 26 can be improved to allow a sufficient performance to be exhibited even with a smaller built-in antenna. The other configuration in this preferred embodiment is similar to that in the previous preferred embodiment; so the description thereof will be omitted.

Figure 10:
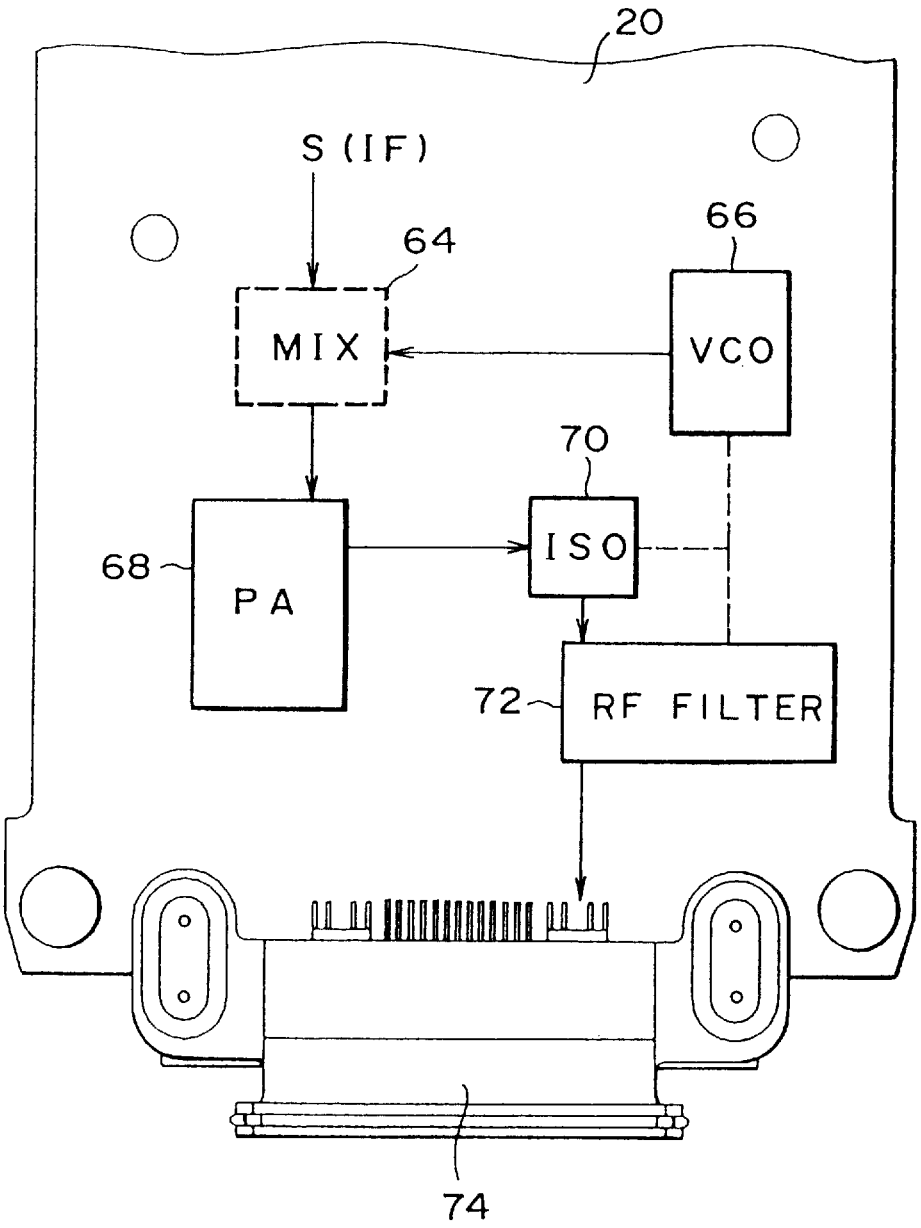
FIG. 10 is a schematic view showing the flow of a transmitting signal.

The flow of a transmitting signal in the portable telephone in this preferred embodiment will now be described in brief with reference to FIG. 10. To high-density mount a voltage controlled oscillator (high-frequency oscillator) 66, an isolator 70, and a high-frequency filter 72 on the printed wiring board 20 along the flow of a transmitting signal, the isolator 70 and the high-frequency filter 72 must be mounted near the voltage controlled oscillator 66.

A main signal S is mixed with a carrier from the voltage controlled oscillator 66 by a mixer 64 mounted on the back surface of the printed wiring board 20, and is next amplified by a preamplifier 68. A signal amplified by the preamplifier 68 is supplied through the isolator 70 and the high frequency filter 72 to a connector 74 connected to the rod antenna 16. In this manner, the isolator 70 and the high-frequency filter 72 are mounted near the voltage controlled oscillator 66, so that there is a problem that the signal amplified by the preamplifier 68 enters the voltage controlled oscillator 66 to cause a reduction in modulation accuracy. To prevent this problem, it is necessary to electromagnetically shield the voltage controlled oscillator 66 from the isolator 70 and the high-frequency filter 72.

Figure 11:
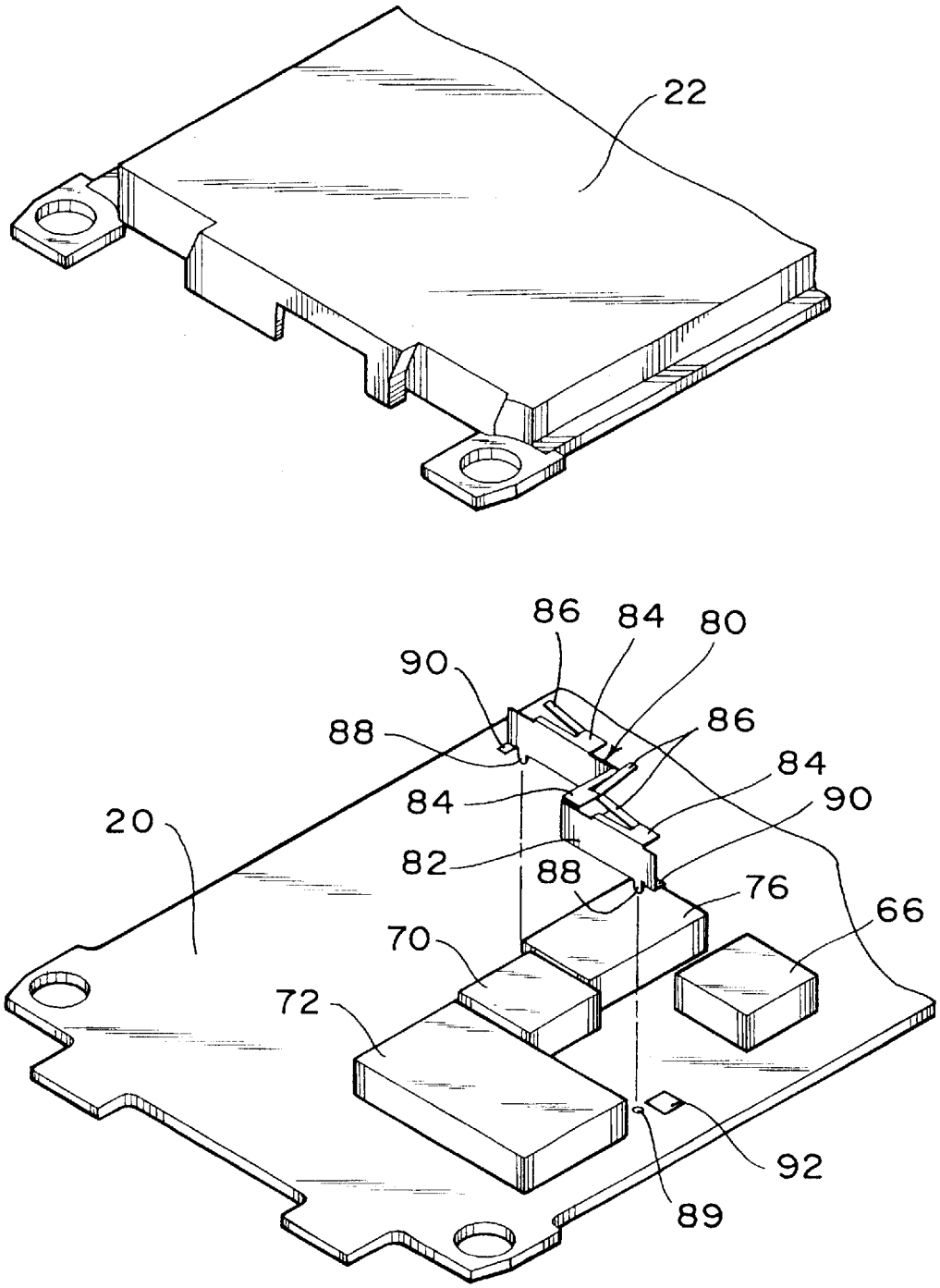
FIG. 11 is an exploded perspective view showing a first preferred embodiment of the shielding structure of the present invention.

Referring to FIG. 11, there is shown an exploded perspective view of a first preferred embodiment of the shielding structure according to the present invention. The printed wiring board 20 is a multilayer printed wiring board having an inner ground layer, and a pair of pads 92 (one of which being shown) connected to the ground layer are exposed to the upper surface of the printed wiring board 20. The isolator 70 and the high-frequency filter 72 are mounted adjacent to the voltage controlled oscillator 66 on the printed wiring board 20. Reference numeral 76 denotes a receiving electronic component.

Reference numeral 80 denotes a metal shield plate formed of phosphor bronze. The metal shield plate 80 is bent so as to correspond to the arrangement of the isolator 70 and the high-frequency filter 72. The metal shield plate 80 has a body portion 82 to be mounted perpendicularly to the printed wiring board 20 and a plurality of bent portions 84 bent at substantially right angles to the body portion 82. Each bent portion 84 is formed with a tongue 86 by cutting and bending. Each tongue 86 has elasticity, that is, it is elastically deformable.

The body portion 82 of the metal shield plate 80 is formed with a pair of positioning projections 88 projecting downward from the lower edge of the body portion 82 and a pair of soldering feet 90 projecting laterally from the lower edge of the body portion 82. On the other hand, the printed wiring board 20 is formed with a pair of positioning holes 89 (one of which being shown) into which the pair of positioning projections 88 of the metal shield plate 80 are respectively inserted.

The metal shield plate 80 is positioned to be mounted on the printed wiring board 20 by inserting the pair of projections 88 of the metal shield plate 80 into the pair of holes 89 of the printed wiring board 20, respectively. In this condition, the pair of feet 90 of the metal shield plate 80 are soldered to the pair of pads 92 of the printed wiring board 20, respectively. Then, the shield chassis 22 whose surface is plated with nickel is mounted so as to cover the printed wiring board 20, and screws are tightened to the shield chassis 22 and the printed wiring board 20, thereby bringing the tongues 86 of the metal shield plate 80 into pressure contact with the shield chassis 22. Accordingly, the voltage controlled oscillator 66 can be effectively electromagnetically shielded from the isolator 70 and the high-frequency filter 72.

According to the shielding structure of this preferred embodiment, the body portion 82 of the metal shield plate 80 is vertically mounted on the printed wiring board 20, and the tongues 86 bent at substantially right angles to the body portion 82 are in pressure contact with the shield chassis 22. Accordingly, electromagnetic shield between electronic components high-density mounted can be effectively obtained with a smaller installation space for the metal shield plate 80.

Figure 12:
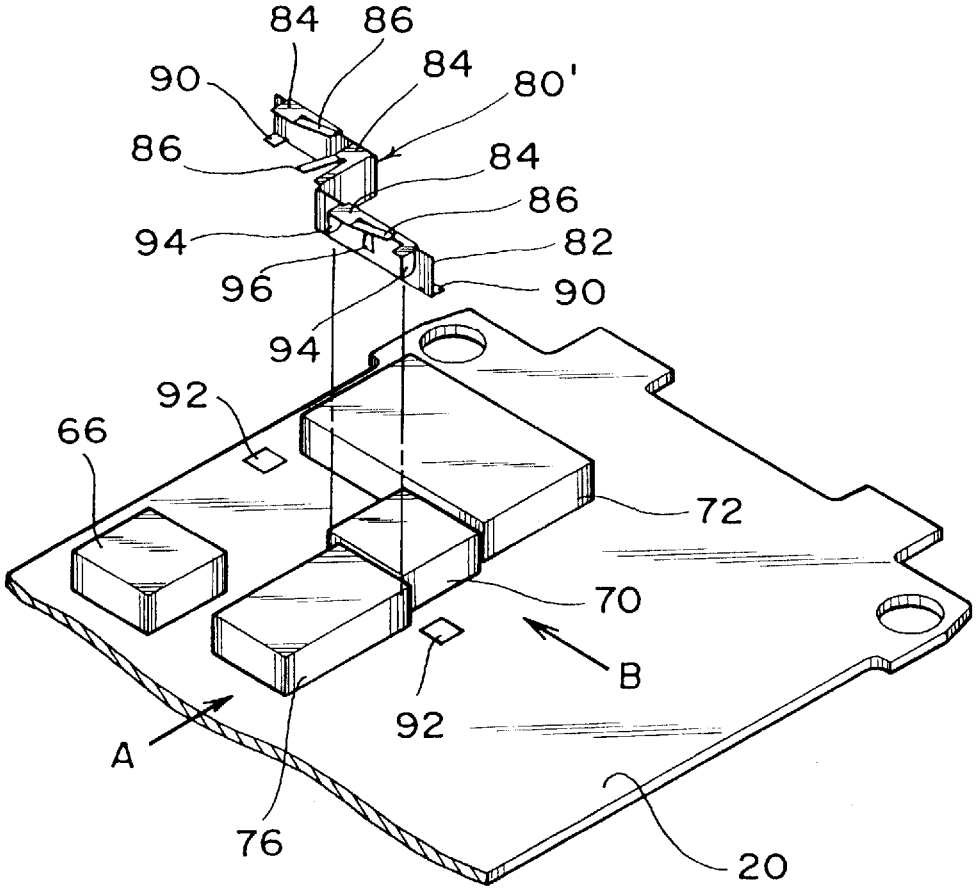
FIG. 12 is an exploded perspective view showing a second preferred embodiment of the shielding structure of the present invention.

Referring to FIG. 12, there is shown an exploded perspective view of a second preferred embodiment of the shielding structure according to the present invention. A metal shield plate 80' in this preferred embodiment is different in structure of positioning the metal shield plate from the metal shield plate 80 in the first preferred embodiment. The other configuration in the second preferred embodiment is similar to that in the first preferred embodiment; so the description thereof will be omitted.

Figure 13:
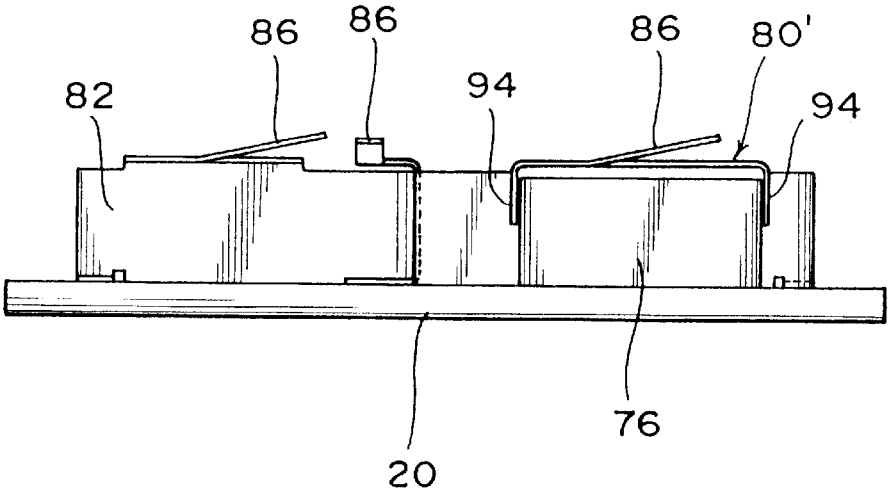
FIG. 13 is a view taken in the direction of an arrow A shown in FIG. 12.
Figure 14:
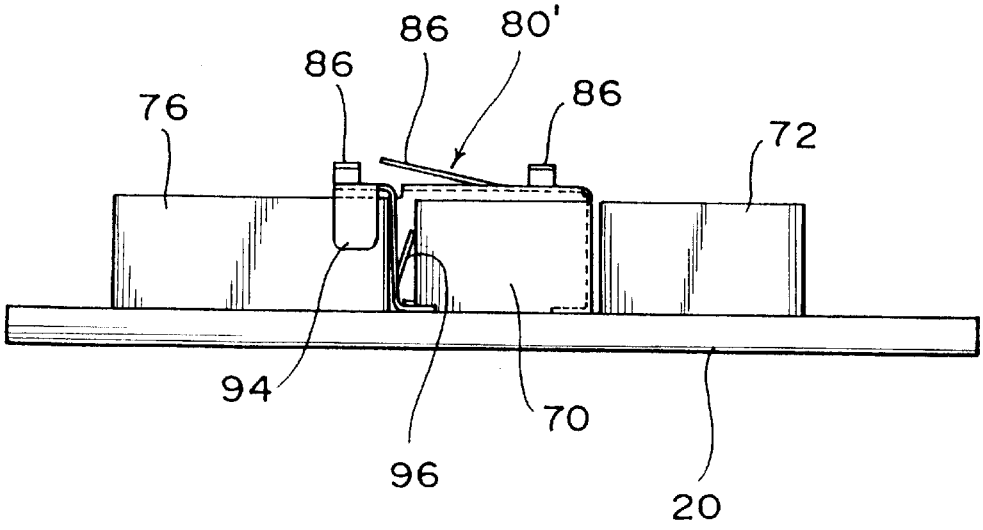
FIG. 14 is a view taken in the direction of an arrow B shown in FIG. 12.

As best shown in FIG. 13, the metal shield plate 80' in the second preferred embodiment has a pair of positioning holders 94 for holding opposite side surfaces of the receiving electronic component 76. Further, as best shown in FIG. 14, the metal shield plate 80' has a positioning tongue 96 adapted to abut against a side surface of the isolator 70 when the metal shield plate 80' is inserted between the isolator 70 and the receiving electronic component 76.

In this manner, the pair of holders 94 are fitted with the electronic component 76, thereby positioning the metal shield plate 80'. Further, the tongue 96 elastically abuts against the isolator 70, thereby preventing undue movement of the metal shield plate 80' mounted on the printed wiring board 20. A pair of feet 90 of the metal shield plate 80' are soldered to the pair of pads 92 of the printed wiring board 20.

Also in this preferred embodiment, as shown in FIG. 11, the shield chassis 22 is mounted so as to cover the printed wiring board 20, so that a plurality of tongues 86 of the metal shield plate 80' come into pressure contact with the shield chassis 22. Further, like the first preferred embodiment, the electronic components high-density mounted can be effectively electromagnetically shielded. According to the second preferred embodiment, it is unnecessary to form any positioning holes on the printed wiring board 20 unlike the first preferred embodiment, so that a degree of freedom of patterning on the multilayer printed wiring board can be enlarged.

While the positioning filters 94 are fitted with the receiving electronic component 76 in the second preferred embodiment, the present invention is not limited to this arrangement. For example, the holders 94 may be made to abut against the isolator 70 or the high-frequency filter 72 by changing the shape of the metal shield plate 80'. Further, the number of the positioning holders 94 is not limited to a pair, but a single holder may be formed so as to abut against one surface of any one of the electronic components 70, 72, and 76, thereby positioning the metal shield plate 80'.

According to the built-in antenna mounting structure of the present invention, the built-in antenna is mounted on the shield chassis rather than on the printed wiring board, so that the built-in antenna does not interfere with a component mounting region of the printed wiring board, thereby allowing high-density mounting on the printed wiring board. Further, according to the shielding structure of the present invention, high-density mounted electronic components can be effectively electromagnetically shielded, thereby realizing size reduction, thickness reduction, and cost reduction of the portable radio equipment.

What is claimed is:

1. A built-in antenna mounting structure for portable radio equipment, comprising:

a shield chassis formed of molded resin, whose surface except an antenna mounting surface is treated with a conductive material;

a printed wiring board mounted on said shield chassis and having a transmitting/receiving circuit;

a built-in antenna formed from a metal plate and mounted on said antenna mounting surface of said shield chassis, said built-in antenna having a platelike antenna element and an elastic short-circuit plate for short-circuiting said antenna element to said shield chassis, said shield chassis being held at an edge portion thereof between said short-circuit plate and said antenna element, thereby mounting said built-in antenna on said shield chassis; and a coaxial cable having a core for connecting said transmitting/receiving circuit and said built-in antenna, said core of said coaxial cable being soldered to said antenna element at a position spaced a given distance from said short-circuit plate.

2. A built-in antenna mounting structure for portable radio equipment according to claim 1, wherein said antenna element has a positioning hole, and said antenna mounting surface of said shield chassis has a projection, said projection being inserted into said positioning hole to thereby position said built-in antenna to said shield chassis.

3. A built-in antenna mounting structure for portable radio equipment according to claim 1, wherein said built-in antenna has a ground element, and an outer conductor of said coaxial cable is soldered to said ground element.

4. A built-in antenna mounting structure for portable radio equipment according to claim 3, wherein said antenna element is integrally formed with a bridge extending in a direction parallel to a wiring direction of said coaxial cable, and said core of said coaxial cable is passed under said bridge and soldered to said antenna element.

5. A built-in antenna mounting structure for portable radio equipment according to claim 4, wherein said antenna element has a pair of positioning projections mutually spaced a distance slightly larger than a diameter of said core of said coaxial cable, thereby positioning said core between said positioning projections of said antenna element.

6. A built-in antenna mounting structure for portable radio equipment according to claim 1, further comprising a dielectric interposed between said antenna element of said built-in antenna and said antenna mounting surface of said shield chassis.

7. A shielding structure for portable radio equipment, comprising:

a shield chassis formed of molded resin, whose surface is treated with a conductive material;

a multilayer printed wiring board mounted on said shield chassis, said multilayer printed wiring board having one surface on which a high-frequency oscillator, a high-frequency filter, and an isolator are mounted;

a metal shield plate having a body portion and an elastically deformable tongue bent at substantially right angles to said body portion, said metal shield plate being mounted on said multilayer printed wiring board so that said tongue is in pressure contact with said shield chassis and said high-frequency oscillator is isolated from said high-frequency filter and said isolator by said body portion; and positioning means for positioning said metal shield plate to said multilayer printed wiring board.

8. A shielding structure for portable radio equipment according to claim 7, wherein said multilayer printed wiring board has an inner ground layer and at least a pair of pads connected to said inner ground layer and exposed to said one surface of said multilayer printed wiring board, and said metal shield plate has at least a pair of feet bent at substantially right angles to said body portion, said feet being soldered to said pads.

9. A shielding structure for portable radio equipment according to claim 7, wherein said positioning means comprises a positioning holder bent at substantially right angles to said body portion and said tongue of said metal shield plate, said positioning holder abutting against one surface of one of said high-frequency filter and said isolator to thereby position said metal shield plate.

10. A shielding structure for portable radio equipment according to claim 7, further comprising an electronic component mounted on said multilayer printed wiring board at a position close to one of said high-frequency filter and said isolator;

said positioning means including a positioning holder bent at substantially right angles to said body portion and said tongue of said metal shield plate, said positioning holder abutting against one surface of said electronic component to thereby position said metal shield plate.

11. A shielding structure for portable radio equipment according to claim 7, wherein said positioning means includes a pair of holes formed on said multilayer printed wiring board and a pair of positioning projections formed integrally with said metal shield plate.

12. A portable radio equipment comprising:

a shield chassis made of molded resin, whose surface, except for an antenna mounting surface, is treated with a conductive material;

a printed wiring board mounted on said shield chassis and having a transmitting/receiving circuit; and a built-in antenna formed from an antenna element and mounted on said antenna mounting surface of said shield chassis, said built-in antenna having an elastic short-circuit plate to short-circuit said antenna element to said shield chassis.

* * * * *